US011607005B2

(12) United States Patent
Wang Chang

(10) Patent No.: US 11,607,005 B2
(45) Date of Patent: Mar. 21, 2023

(54) MOISTURE-PERMEABLE WATERPROOF SHOE

(71) Applicant: VESSI FOOTWEAR LTD., Vancouver (CA)

(72) Inventor: Fang-Chun Wang Chang, Taichung (TW)

(73) Assignee: VESSI FOOTWEAR LTD., Vancouver (CA)

( * ) Notice: Subject to any disclaimer, the term of this patent is extended or adjusted under 35 U.S.C. 154(b) by 0 days.

(21) Appl. No.: 17/322,644

(22) Filed: May 17, 2021

(65) Prior Publication Data

US 2021/0378354 A1 Dec. 9, 2021

(30) Foreign Application Priority Data

Jun. 3, 2020 (TW) ..... 109206951

(51) Int. Cl.
*A43B 7/12* (2006.01)
*A43B 23/07* (2006.01)
*A43B 23/02* (2006.01)

(52) U.S. Cl.
CPC ..... *A43B 7/125* (2013.01); *A43B 23/0235* (2013.01); *A43B 23/0255* (2013.01); *A43B 23/07* (2013.01)

(58) Field of Classification Search
CPC ..... A43B 7/125; A43B 23/022; A43B 7/12; A43B 23/07; A43B 23/06; A43B 23/042; A43B 23/025; A43B 23/026
See application file for complete search history.

(56) References Cited

U.S. PATENT DOCUMENTS

2002/0053148 A1* 5/2002 Haimerl ..... A43B 9/12 36/55
2003/0009908 A1* 1/2003 Sheets ..... A43B 7/125 36/55
2004/0006888 A1* 1/2004 Moretti ..... A43B 7/06 36/3 B
2004/0049942 A1* 3/2004 Chen ..... A43B 7/085 36/55
2010/0011619 A1* 1/2010 Bastianelli ..... A43B 9/02 36/87
2012/0174444 A1* 7/2012 Besanceney, III ..... A43B 17/08 36/43
2014/0196316 A1* 7/2014 Follet ..... A43C 1/04 36/84

(Continued)

*Primary Examiner* — Sharon M Prange
*Assistant Examiner* — Grady Alexander Nunnery
(74) *Attorney, Agent, or Firm* — Hamre, Schumann, Mueller & Larson, P.C.

(57) ABSTRACT

A moisture-permeable waterproof shoe includes an upper unit, an inner sleeve unit, and an outsole unit. The upper unit defines an inner space having a top open end and a bottom closed end. The inner sleeve unit is fixedly disposed in the inner space, and includes a moisture-permeable waterproof shoe-like inner sleeve and a thermoplastic polyurethane (TPU) sheet. The moisture-permeable waterproof shoe-like inner sleeve has an inner sleeve bottom surface and defines a wearing space having a top open end and a bottom closed end. The TPU sheet has a top surface fixedly connected to the inner sleeve bottom surface by a high-frequency welding method. The outsole unit is fixedly connected to an underside of the upper unit.

4 Claims, 10 Drawing Sheets

(56) References Cited

U.S. PATENT DOCUMENTS

| | | | | |
|---|---|---|---|---|
| 2018/0153257 | A1* | 6/2018 | Chang | A43C 11/1493 |
| 2019/0223545 | A1* | 7/2019 | Chang | A43B 23/0235 |
| 2019/0297991 | A1* | 10/2019 | Bongers | A43B 23/042 |

* cited by examiner

MOISTURE-PERMEABLE WATERPROOF SHOE

CROSS-REFERENCE TO RELATED APPLICATION

This application claims priority of Taiwanese Patent Application No. 109206951, filed on Jun. 3, 2020.

FIELD

The disclosure relates to a moisture-permeable waterproof shoe, and more particularly to a moisture-permeable waterproof shoe including a thermoplastic polyurethane sheet connected to an inner sleeve thereof by a high-frequency welding method.

BACKGROUND

A conventional moisture-permeable waterproof shoe generally includes an upper having a sock-shape, a waterproof inner sleeve fixedly disposed in an inner part of the upper, and an outsole fixedly disposed on a bottom side of the upper. Waterproof strips are usually attached onto the waterproof inner sleeve at seaming edges to enhance waterproof effect. However, once the waterproof strips are improperly attached to the seaming edges at the bottom portion of the waterproof inner sleeve, it would directly affect the waterproof effect of the waterproof inner sleeve at the bottom portion thereof.

SUMMARY

Therefore, an object of the present disclosure is to provide a moisture-permeable waterproof shoe that can alleviate at least one of the drawbacks of the prior art.

According to the present disclosure, a moisture-permeable waterproof shoe includes an upper unit, an inner sleeve unit, and an outsole unit. The upper unit defines an inner space having a top open end and a bottom closed end. The inner sleeve unit is fixedly disposed in the inner space, and includes a moisture-permeable waterproof shoe-like inner sleeve and a thermoplastic polyurethane (TPU) sheet. The moisture-permeable waterproof shoe-like inner sleeve has an inner sleeve bottom surface and defines a wearing space having a top open end and a bottom closed end. The TPU sheet has a top surface fixedly connected to the inner sleeve bottom surface by a high-frequency welding method. The outsole unit is fixedly connected to an underside of the upper unit.

BRIEF DESCRIPTION OF THE DRAWINGS

Other features and advantages of the present disclosure will become apparent in the following detailed description of the embodiment with reference to the accompanying drawings, of which.

DETAILED DESCRIPTION

Figure 1:
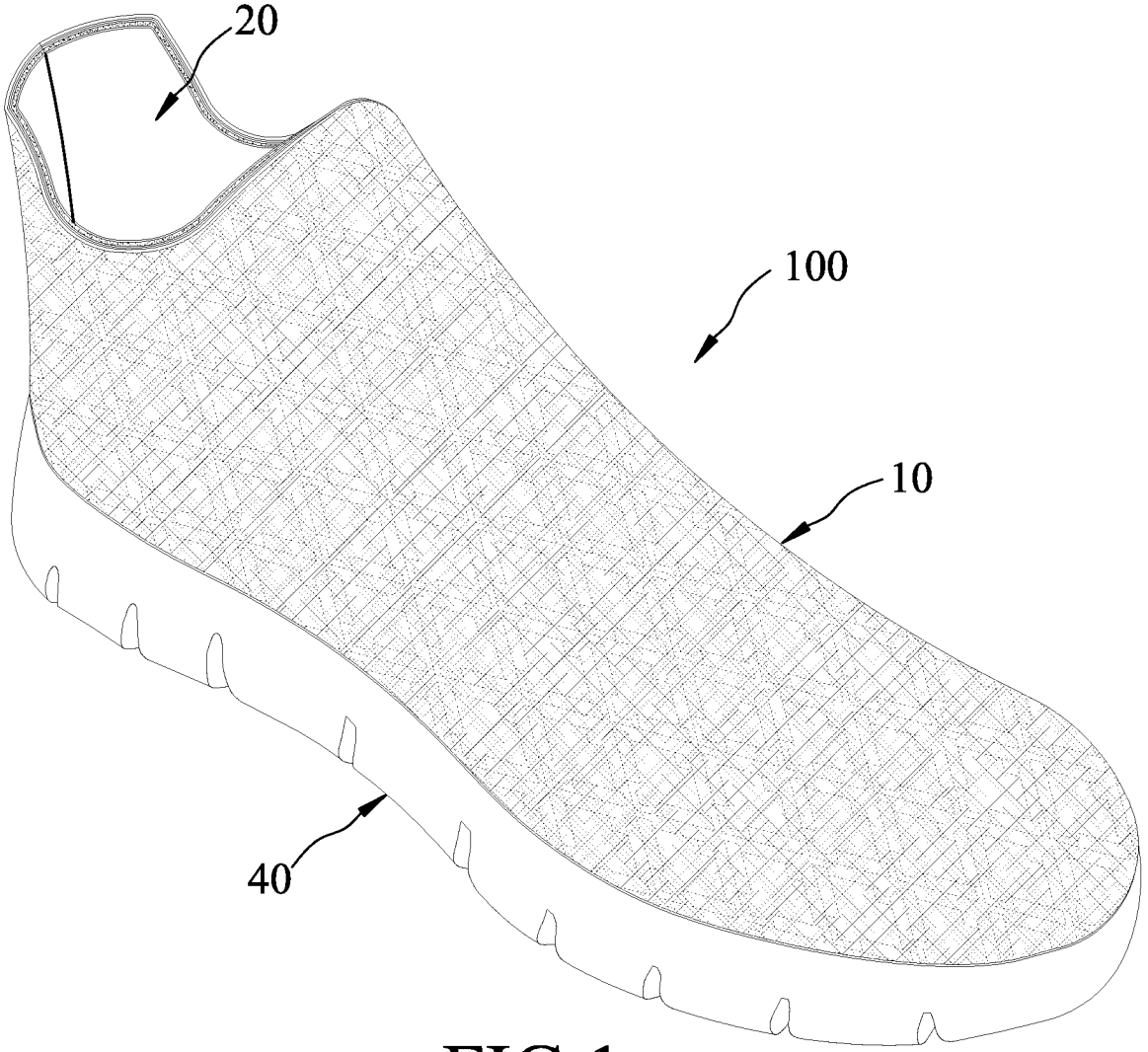
FIG. 1 is a perspective view of a moisture-permeable waterproof shoe according to an embodiment of the present disclosure.

Referring to FIGS. 1 to 4, an embodiment of a moisture-permeable waterproof shoe 100 according to the present disclosure includes an upper unit 10, an inner sleeve unit 20, an adhesion layer 30, and an outsole unit 40.

The upper unit 10 defines an inner space 11 having a top open end and a bottom closed end. In this embodiment, the upper unit 10 is made by sewing a cut piece 12, and includes a toe stitched portion 13, a heel stitched portion 14, a sole stitched portion 15, and a rear end stitched portion 16. The toe stitched portion 13, the heel stitched portion 14, the sole stitched portion 15, and the rear end stitched portion 16 are formed by sewing threads. In this embodiment, the cut piece 12 is made of a woven fabric, but is not limited thereto.

Figure 2:
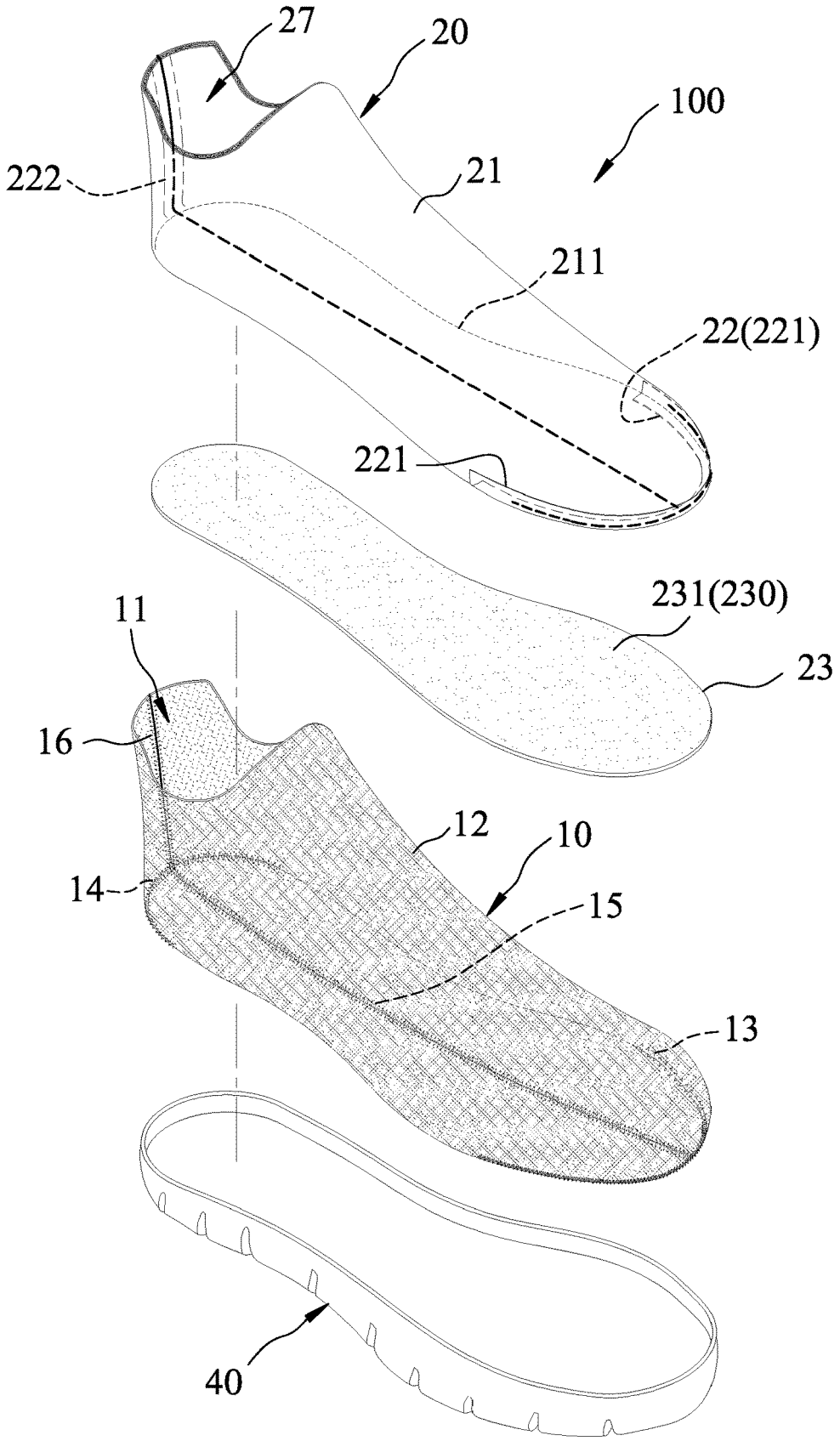
FIG. 2 is an exploded perspective view of the embodiment.
Figure 3:
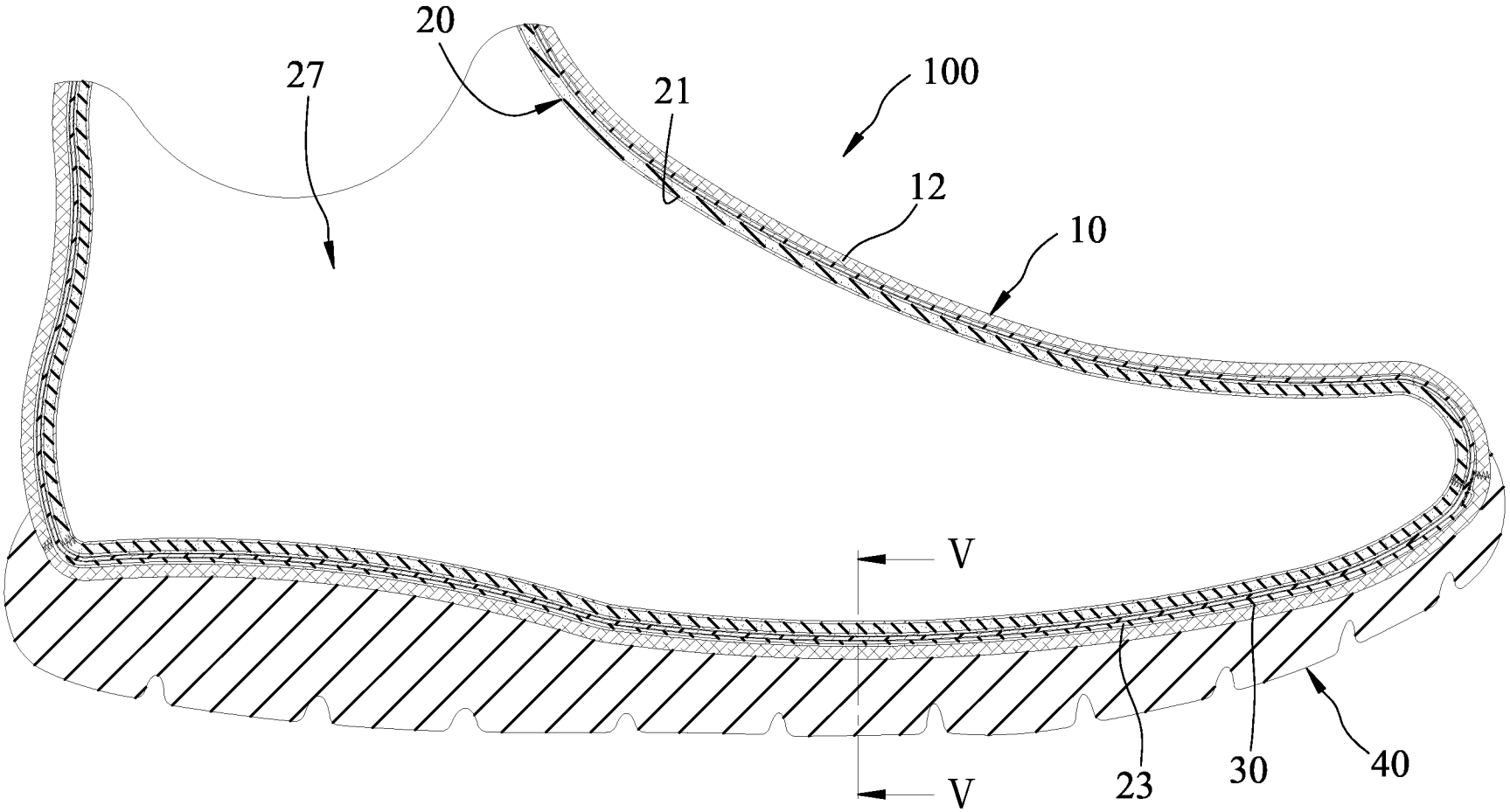
FIG. 3 is an assembled schematic sectional view of the embodiment.

The inner sleeve unit 20 is fixedly disposed in the inner space 11, and includes a moisture-permeable waterproof shoe-like inner sleeve 21, a waterproof element set 22 disposed on an outer surface of the moisture-permeable waterproof shoe-like inner sleeve 21, and a thermoplastic polyurethane (TPU) sheet 23. The moisture-permeable waterproof shoe-like inner sleeve 21 has an inner sleeve bottom surface 211, and defines a wearing space 27 having a top open end and a bottom closed end. The TPU sheet has a top surface 231 which is fixedly connected to the inner sleeve bottom surface 211 by a high-frequency welding method, and which completely covers and seals the inner sleeve bottom surface 211, as shown in FIGS. 2 and 3.

In this embodiment, the moisture-permeable waterproof shoe-like inner sleeve 21 is made from a tailored sheet 24 that includes a lining cloth layer 241, a surface cloth layer 242 positioned on an outer side of the lining cloth layer 241, a foam layer 243 fixedly connected between the lining cloth layer 241 and the surface cloth layer 242, and a moisture-permeable waterproof layer 244 fixedly connected to an outer side of the surface cloth layer 242. The moisture-permeable waterproof layer 244 is made of polyurethane (PU), but is not limited thereto.

Figure 7:
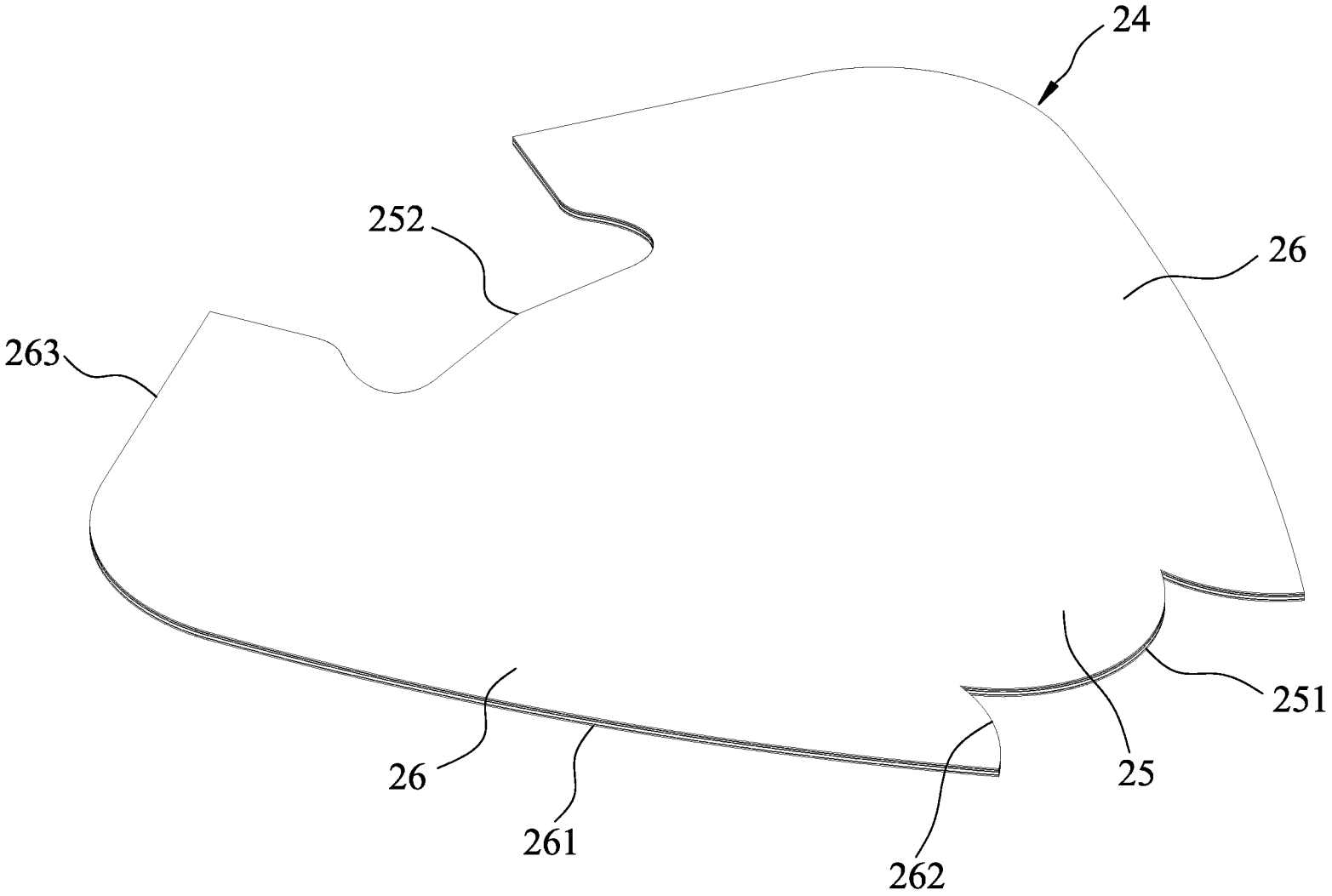
FIG. 7 is a perspective view of a tailored sheet used for making a moisture-permeable waterproof shoe-like inner sleeve of an inner sleeve unit of the embodiment.
Figure 8:
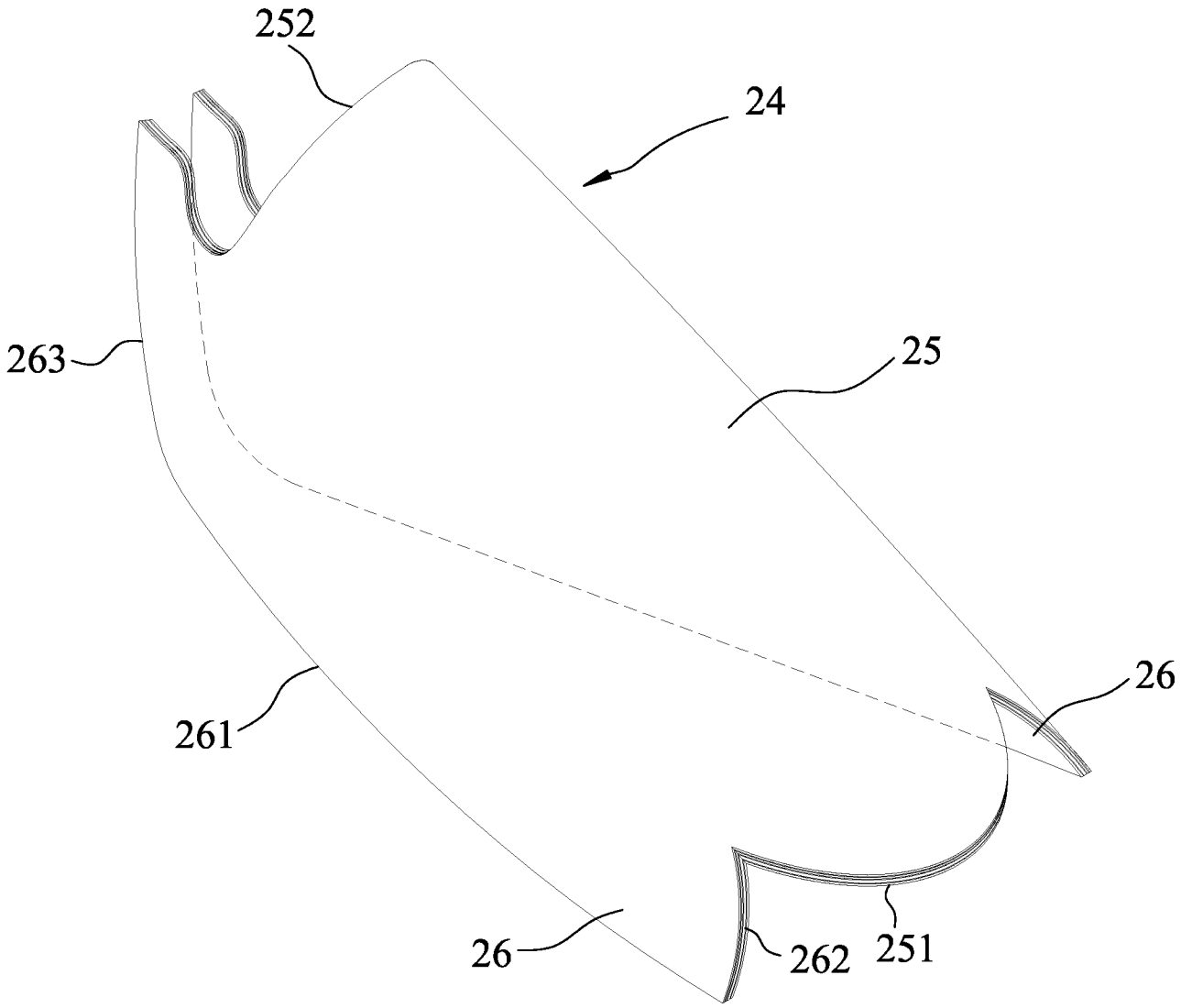
FIG. 8 is a perspective view illustrating how the tailored sheet is folded into a prototype of the moisture-permeable waterproof shoe-like inner sleeve.
Figure 9:
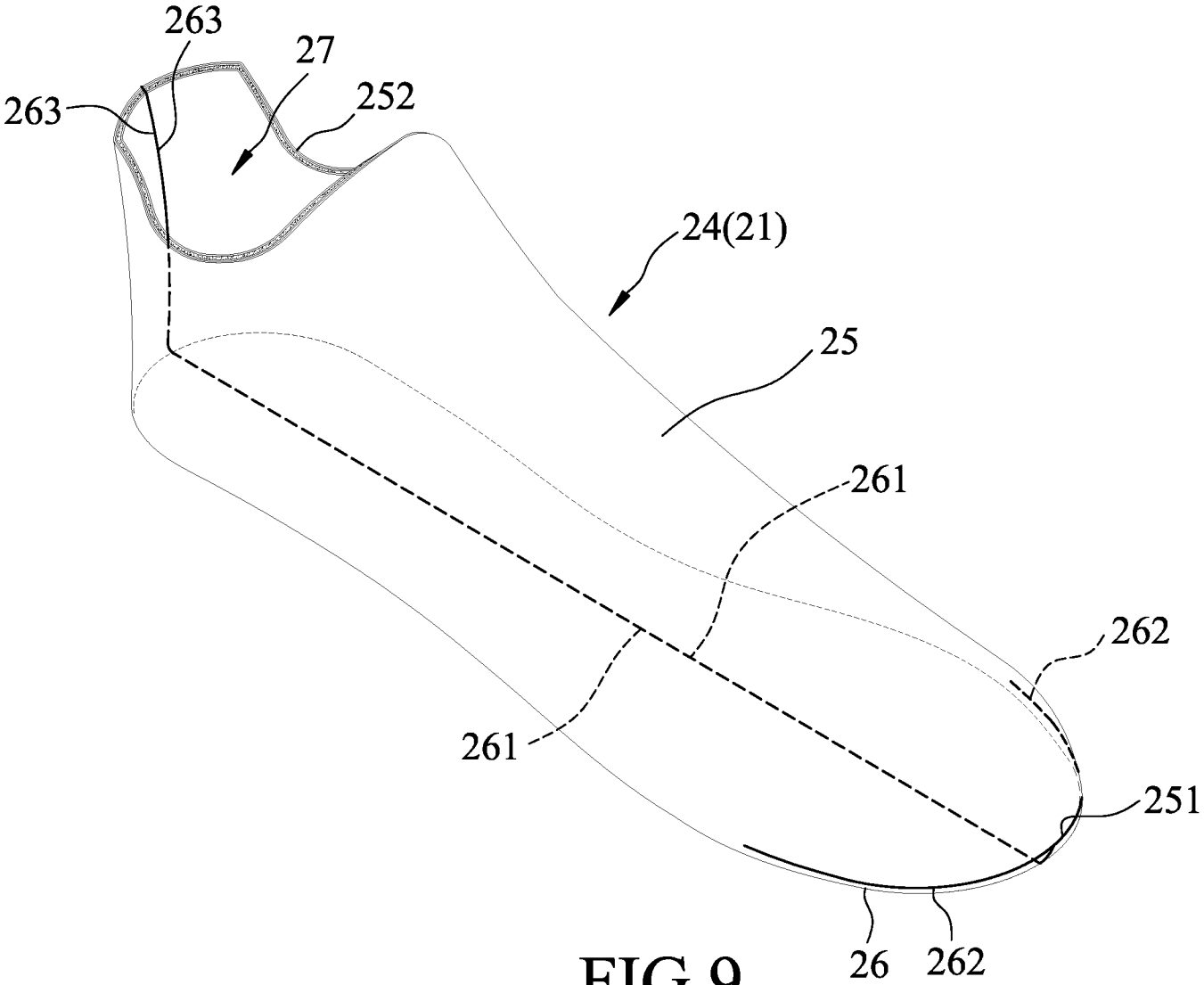
FIG. 9 is a perspective view of the moisture-permeable waterproof shoe-like inner sleeve formed through sewing of the tailored sheet.

Referring to FIGS. 7 to 9, in this embodiment, the tailored sheet 24 includes a main sheet portion 25, and two side wing portions 26 symmetrically disposed on two opposite sides of the main sheet portion 25 and integrally connected to the main sheet portion 25. The main sheet portion 25 has a front convex edge 251 and a rear concave edge 252. Each of the side wing portions 26 has a lateral seaming edge 261, a front curved seaming edge 262 connected between the lateral seaming edge 261 and one end of the front convex edge 251, and a rear seaming edge 263 connected between the lateral seaming edge 261 and one end of the rear concave edge 252.

The front curved seaming edges 262 of the side wing portions 26 are sewn to the front convex edge 251, the lateral seaming edges 261 of the side wing portions 26 are sewn to each other, and the rear seaming edges 263 of the side wing portions 26 are sewn to each other, thereby forming the moisture-permeable waterproof shoe-like inner sleeve 21. In this embodiment, the length of the front curved seaming edge 262 of each side wing portion 26 is substantially equal to one-half of the length of the front convex edge 251 of the main sheet portion 25.

Figure 4:
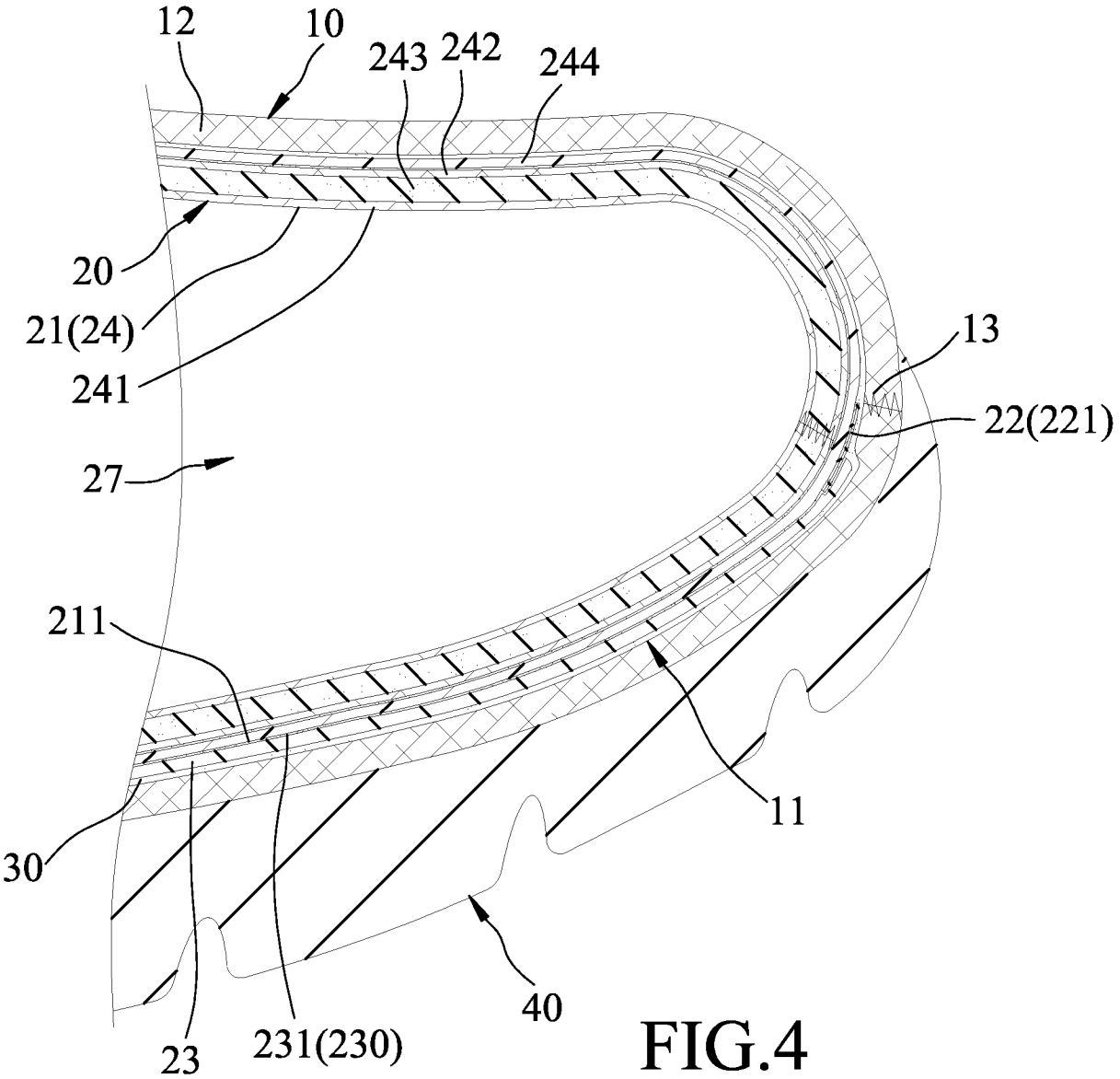
FIG. 4 is an enlarged fragmentary sectional view of FIG. 3.
Figure 10:
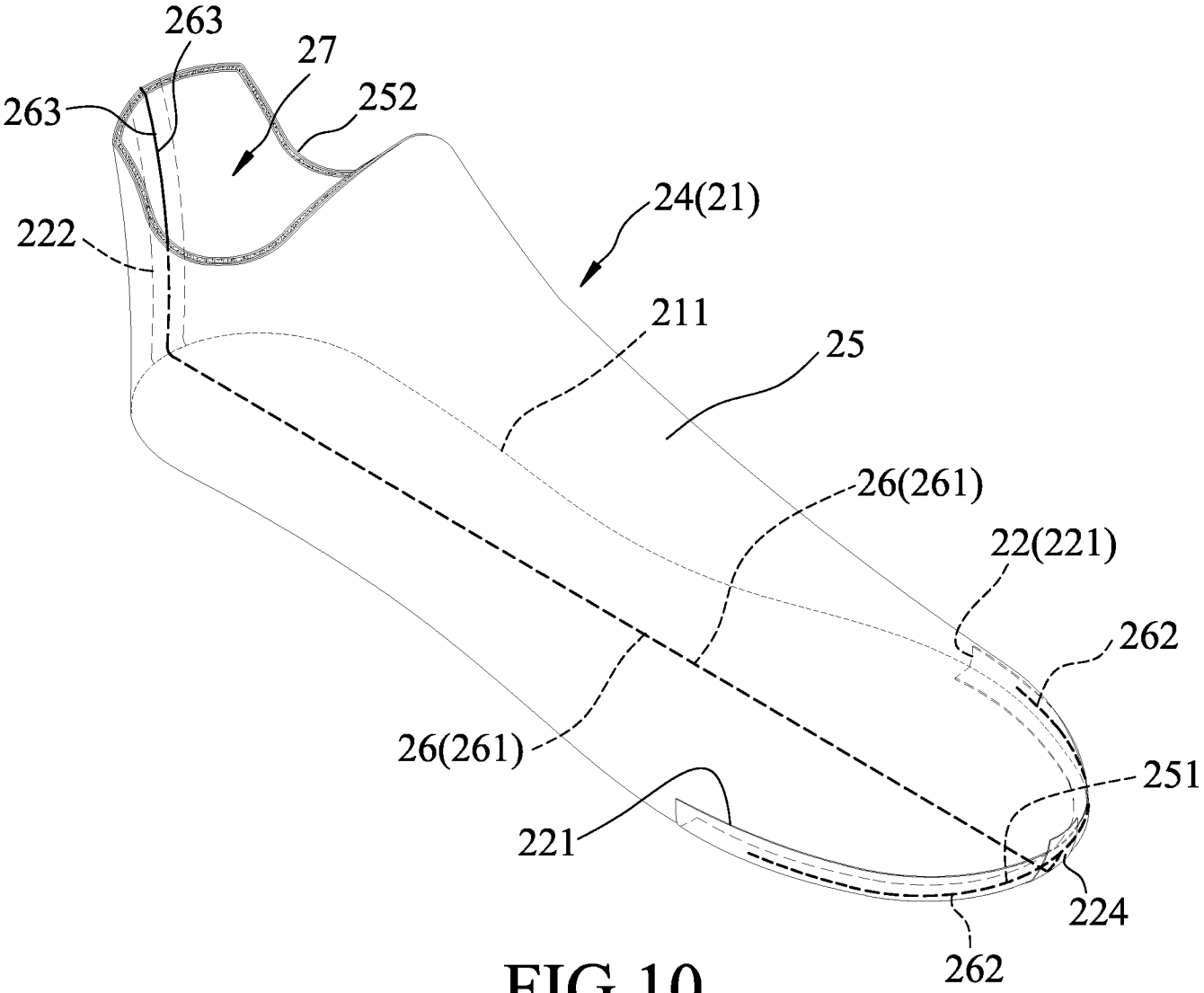
FIG. 10 is a view similar to FIG. 9, but illustrating a waterproof element set of the inner sleeve unit covering seams of the tailored sheet.

Referring to FIG. 10, in combination with FIGS. 4 and 9, the waterproof element set 22 includes two first waterproof strips 221 and a second waterproof strip 222 fixedly adhered to an outer surface of the moisture-permeable waterproof layer 244. Specifically, one of the first waterproof strips 221 extends along and covers a seam formed between the front curved seaming edge 262 of one of the side wing portions 26 and the one end of the front convex edge 251 of the main sheet portion 25, and the other first waterproof strip 221 extends along and covers a seam formed between the front curved seaming edge 262 of the other side wing portion 26 and the other end of the front convex edge 251. The second waterproof strip 222 extends along and covers a seam formed between the rear seaming edges 263 of the side wing portions 26.

Figure 5:
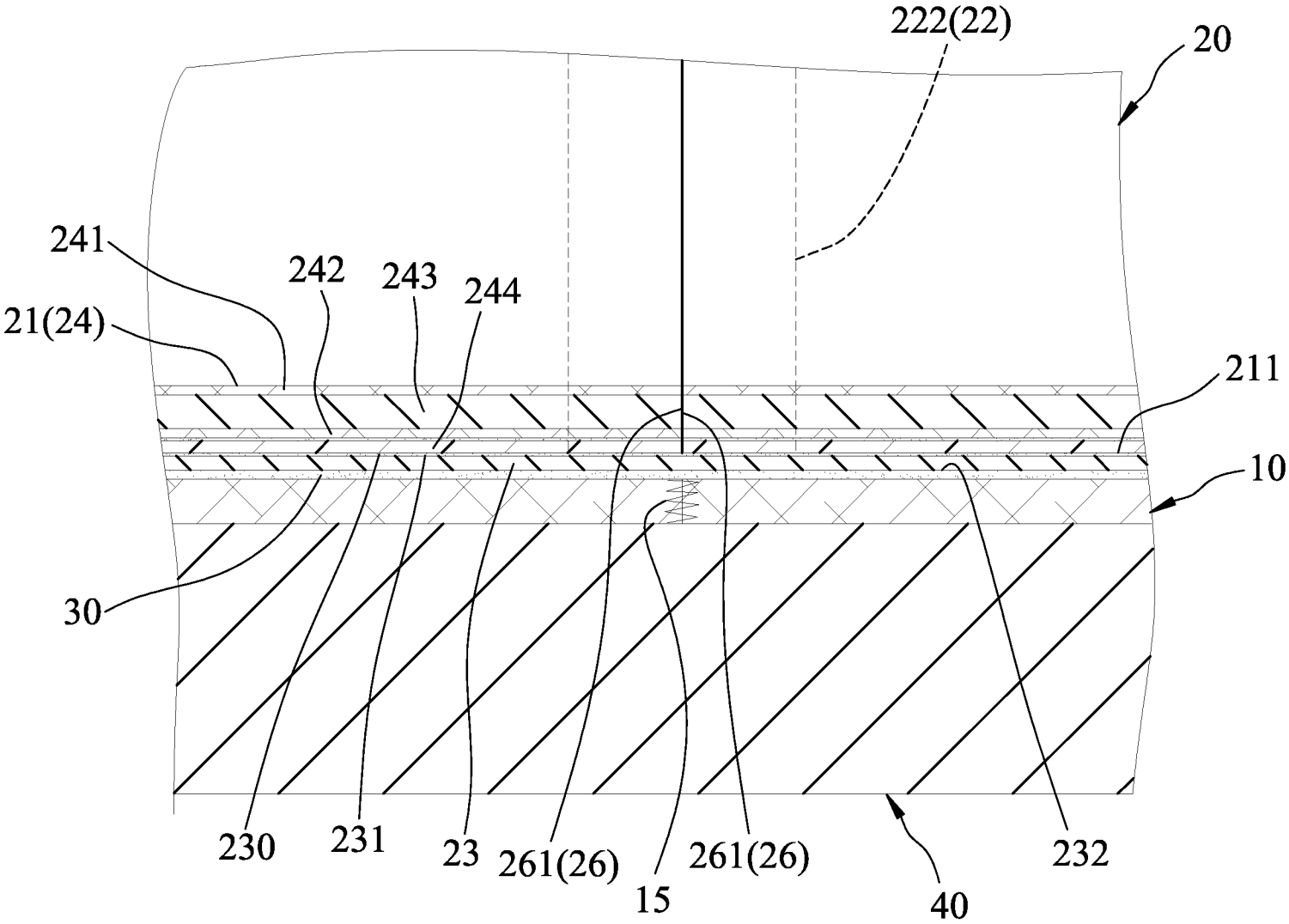
FIG. 5 is a sectional view taken along line V-V of FIG. 3.

With reference to FIGS. 2, 4 and 5, the inner sleeve unit 20 further includes a hot melt adhesive layer 230 adhered between the inner sleeve bottom surface 211 and the top surface 231 of the TPU sheet 23 by the high-frequency welding method so as to fixedly connect the TPU sheet 23 and the moisture-permeable waterproof shoe-like inner sleeve 21. It should be noted that the hot melt adhesive layer 230 can strengthen the bonding between the TPU sheet 23 and the moisture-permeable waterproof shoe-like inner sleeve 21.

Figure 6:
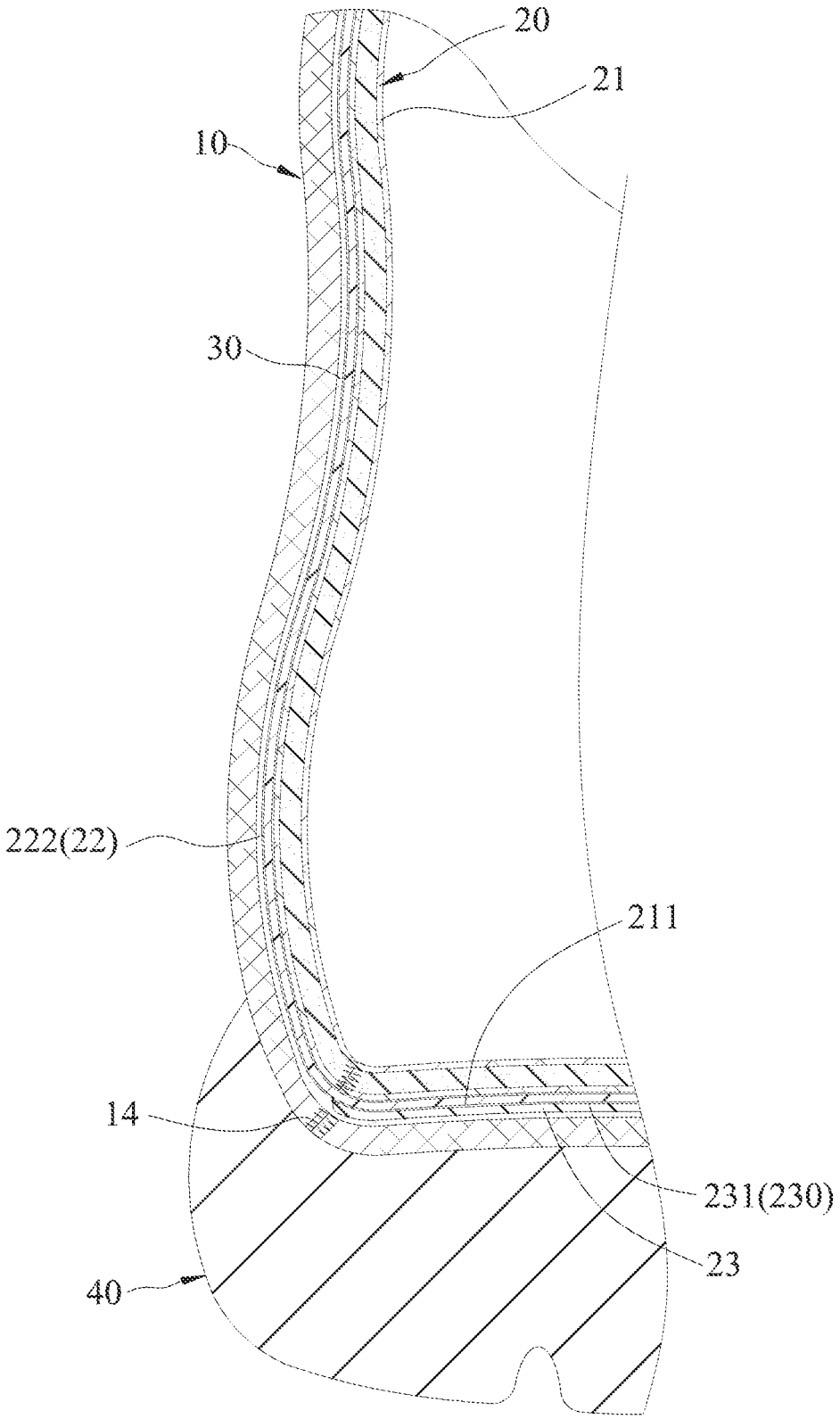
FIG. 6 is another enlarged fragmentary sectional view of FIG. 3.

Referring again to FIGS. 4 to 6, in this embodiment, the top surface of the TPU sheet 23 seals a seam formed between the lateral seaming edges 261 of the side wing portions 26 which is located at the inner sleeve bottom surface 211. The TPU sheet 23 has a thickness ranging from 0.2 mm to 0.3 mm.

Referring back to FIGS. 2 to 4, the adhesion layer 30 is adhered between an inner surface of the upper unit 10 and an cuter surface of the inner sleeve unit 20.

The outsole unit 40, as shown in FIGS. 2 to 4, is fixedly connected to an underside of the upper unit 10.

Based on the above description, the advantages of the moisture-permeable waterproof shoe 100 of this disclosure can be summarized as follows:

1. By utilizing the high-frequency welding method to heat the hot-melt adhesive layer 230, the TPU sheet 23 can be fixedly connected to and completely covers and seals the inner sleeve bottom surface 211 of the moisture-permeable waterproof shoe-like inner sleeve 21 and can seal the seam of the lateral seaming edges 261 of the side wing portions 26 located at the inner sleeve bottom surface 211, thereby permitting the moisture-permeable waterproof shoe-like inner sleeve 21 to have a good waterproof effect. Further, in comparison with the prior art, there is no need to attach waterproof strips to the inner sleeve bottom surface 211 of the moisture-permeable waterproof shoe-like inner sleeve 21, thereby effectively reducing the number of waterproof strips used.

2. Since the hot melt adhesive layer 230 can be used to strengthen the bonding between the TPU sheet 23 and the moisture-permeable waterproof shoe-like inner sleeve 21, the sealing effect on the inner sleeve bottom surface 211 of the moisture-permeable waterproof shoe-like inner sleeve 21 can be enhanced.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the present disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A moisture-permeable waterproof shoe, comprising:

an upper unit defining an inner space having a top open end and a bottom closed end;

an inner sleeve unit fixedly disposed in said inner space and including a moisture-permeable waterproof shoe-like inner sleeve having an inner sleeve bottom surface and defining a wearing space that has a top open end and a bottom closed end, said moisture-permeable waterproof shoe-like inner sleeve being made from a tailored sheet that includes a lining cloth layer, a surface cloth layer positioned on an outer side of said lining cloth layer, a foam layer fixedly connected between said lining cloth layer and said surface cloth layer, and a moisture-permeable waterproof layer fixedly connected to an outer side of said surface cloth layer, and a thermoplastic polyurethane (TPU) sheet having a top surface fixedly connected to said inner sleeve bottom surface by a high-frequency welding method; and an outsole unit fixedly connected to an underside of said upper unit, wherein said top surface of said TPU sheet completely covers and seals said inner sleeve bottom surface;

wherein said tailored sheet includes a main sheet portion having a front convex edge and a rear concave edge, and two side wing portions symmetrically disposed on two opposite sides of said main sheet portion and integrally connected to said main sheet portion, each of said side wing portions having a lateral seaming edge, a front curved seaming edge connected between said lateral seaming edge and one end of said front convex edge, and a rear seaming edge connected between said lateral seaming edge and one end of said rear concave edge;

wherein said front curved seaming edges of said side wing portions are sewn to said front convex edge, said lateral seaming edges of said side wing portions are sewn to each other, and said rear seaming edges of said side wing portions are sewn to each other to thereby form said moisture-permeable waterproof shoe-like inner sleeve;

wherein said inner sleeve unit further includes a waterproof element set disposed on an outer surface of said moisture-permeable waterproof shoe-like inner sleeve, said waterproof element set including two first waterproof strips and a second waterproof strip;

wherein one of said first waterproof strips extends along and covers a seam formed between said front curved seaming edge of one of said side wing portions and said one end of said front convex edge of said main sheet portion, and the other one of said first waterproof strips extends along and covers a seam formed between said front curved seaming edge of the other one of said side wing portions and the other end of said front convex edge of said main sheet portion;

wherein said second waterproof strip extends along and covers a seam formed between said rear seaming edges of said side wing portions; and wherein said top surface of said TPU sheet seals a seam formed between said lateral seaming edges of said side wing portions which is located at said inner sleeve bottom surface.

2. The moisture-permeable waterproof shoe as claimed in claim 1, wherein said TPU sheet has a thickness ranging from 0.2 mm to 0.3 mm.

3. The moisture-permeable waterproof shoe as claimed in claim 1, wherein said inner sleeve unit further includes a hot melt adhesive layer adhered between said inner sleeve bottom surface and said top surface of said TPU sheet by the high-frequency welding method.

4. The moisture-permeable waterproof shoe as claimed in claim 1, further comprising an adhesion layer adhered between an inner surface of said upper unit and an outer surface of said inner sleeve unit.

* * * * *